United States Patent [19]

Burout, III

[11] Patent Number: 4,866,844

[45] Date of Patent: Sep. 19, 1989

[54] RAZOR HEAD ASSEMBLY

[75] Inventor: Charles J. Burout, III, Oxford, Conn.

[73] Assignee: Warner-Lambert Company, Morris Plains, N.J.

[21] Appl. No.: 161,335

[22] Filed: Mar. 11, 1988

[51] Int. Cl.[4] ..... B26B 21/06

[52] U.S. Cl. ..... 30/50; 30/47; 30/84; 30/346.58

[58] Field of Search ..... 30/50, 32, 47, 346.58, 30/346.57, 346.59, 84, 48, 49; 29/505, 506, 507, 508

[56] References Cited

U.S. PATENT DOCUMENTS

| | | | |
|---|---|---|---|
| Re. 30,913 | 4/1982 | Cartwright et al. | 30/50 X |
| 3,890,704 | 6/1975 | Ferraro | 30/50 |
| 4,205,437 | 6/1980 | Chen et al. | 30/41 |
| 4,337,575 | 7/1982 | Trotta | 30/50 |
| 4,443,939 | 4/1984 | Motta et al. | 30/50 X |
| 4,535,537 | 8/1985 | Ferraro et al. | 30/50 |

*Primary Examiner*—Frank T. Yost
*Assistant Examiner*—Y. Lin
*Attorney, Agent, or Firm*—Howard Olevsky; Daniel A. Scola, Jr.

[57] ABSTRACT

According to this invention a means of staking is provided in which a portion of the stake near the bottom is subjected to shearing and cold-forming to form a skirt. The skirt provides a locking assembly for the component parts of the razor head without chamfering the area around the receiving orifices. The locking is also done without the possibility of bending, deforming or shattering the individual stakes themselves.

6 Claims, 2 Drawing Sheets

RAZOR HEAD ASSEMBLY

FIELD OF THE INVENTION

This invention relates to razor heads and methods of assembling the same.

BACKGROUND OF THE INVENTION

Razor cartridges and the non-handled portion of disposable razors (hereinafter referred to generically as razor heads) generally consist of a blade support surface with a guard bar extending from its leading edge, either a single blade or a pair of blades which may be separated by a spacer element and a cap. The blades, in one method of assembly, have either orifices or slots and are positioned over pins extending upward from the top of the blade support portion or downward from the cap. If the stakes or pins depend downward from the cap they extend through the blade support portion and are anchored in the bottom of the support portion. U.S. Pat. No. 4,205,437 issued to Evan N. Chen and Bryan J. Goddard depicts such an assembly. U.S. Pat. No. 4,535,537 issued to Frank A. Ferraro and David S. Byrne discloses a system whereby the staking means are positioned in the blade support surface and extend upward through the bottom of the cap to engage the surface on the top portion of the cap. In both of these instances, the component parts of the blade head are locked in place by applying a force to the bottom of the pin to deform the bottom and spread it out into a rivet-like configuration having a wider diameter than that of the adjacent part of the pin. The cold riveting operation can bend, deform or at times even crack the pin. This is particularly more likely if the force is delivered to the point of the pin and is not applied equally across the bottom profile.

U.S. Pat. No. 4,443,939 issued to Vincent C. Motta and Ernest F. Kiraly discloses staking with a "pop bead" approach. In this instance a stake having an inwardly tapering diameter as it extends downward terminates in a solid spheroid. The orifices positions in the receiving portion of the blade support surface, have a chamfered area around the orifice. Because of the reduced thickness in the chamfered area, the orifice, which is smaller in diameter tha the spheroid at the end of the stake, can be pushed through the orifice by deflecting the chamfered area downward. In theory, the chamfered area then springs back and positions itself around the area of tapering reduced thickness immediately preceding the sphere. This spheroid takes the place of the staking rivet and eliminates the stresses put on the pin by the riveting operation. Unfortunately, in a number of cases, the chamfered area is deflected downward but, after passage of the enlarged spheroid, does not spring back, but remains in the downwardly deflected configuration. This bending widens the hole and eliminates the secure locking fit required for razor head assembly.

SUMMARY OF THE INVENTION

According to this invention a means of staking is provided in which a portion of the pin near its bottom end is subjected to shearing and cold forming to form a skirt. The skirt provides a locking assembly for the component parts of the razor head. For the purposes of this invention skirt is used to describe a radially disposed symmetrically positioned area of increased radial width positioned slightly upward from the pin or stake bottom and used to abut against the downwardly deflected chamfered area from below. For the purposes of this invention a skirt is defined as an area preferably symmetrically disposed radially around the pin or stake which may be continuous or discontinuous and located slightly upward from the pin bottom. The locking is also done without the possibility of bending, deforming or shattering the individual stakes themselves.

BRIEF DESCRIPTION OF THE DRAWINGS

The invention may be more readily understood by reference to the drawings in which.

DETAILED DESCRIPTION OF THE INVENTION AND CLAIMS

Figure 1:
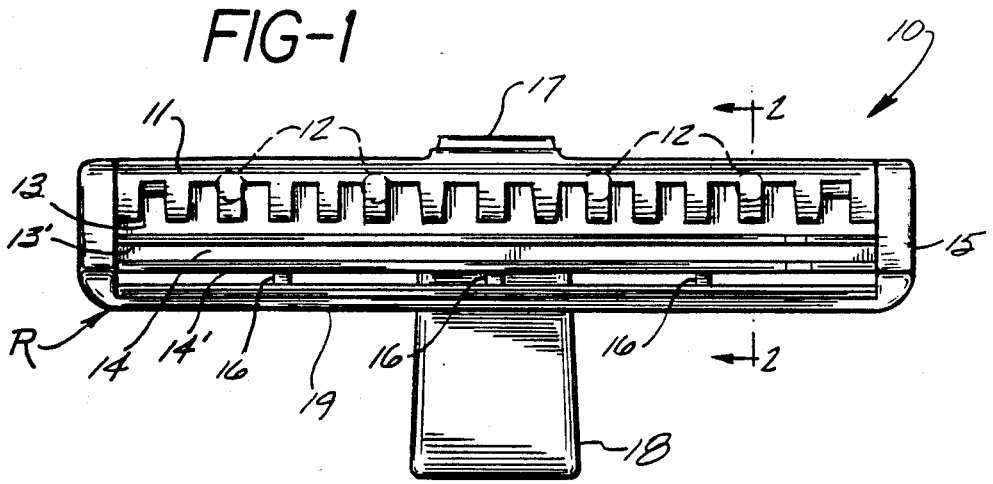
FIG. 1 is a front perspective view of a razor.

A typical disposable razor is shown in FIG. 1 in which a razor head 10 is connected to a handle 18 by connecting portion 17. A fingered cap 11 overlies a first or cap blade 13 separated by spacer element 27 (see FIG. 2). Cap 11 has an outer surface **11*a* and an inner surface 11*b*. A second or seat blade 14 has a blade cutting edge 14 extending parallel to and outward from cap blade cutting edge 13'. Cap sides 15 cover the blades at their transverse edges to prevent the edges from gouging the user. Guard bar 19 is connected to a seat 25 (see FIG. 2) by three outstanding ribs 16. Seat 25 has an outer surface 25*a* and an inner surface 25*b*. The guard bar 19, ribs 16 and seat portion 25** provide the unitary blade support portion.

Figure 2:
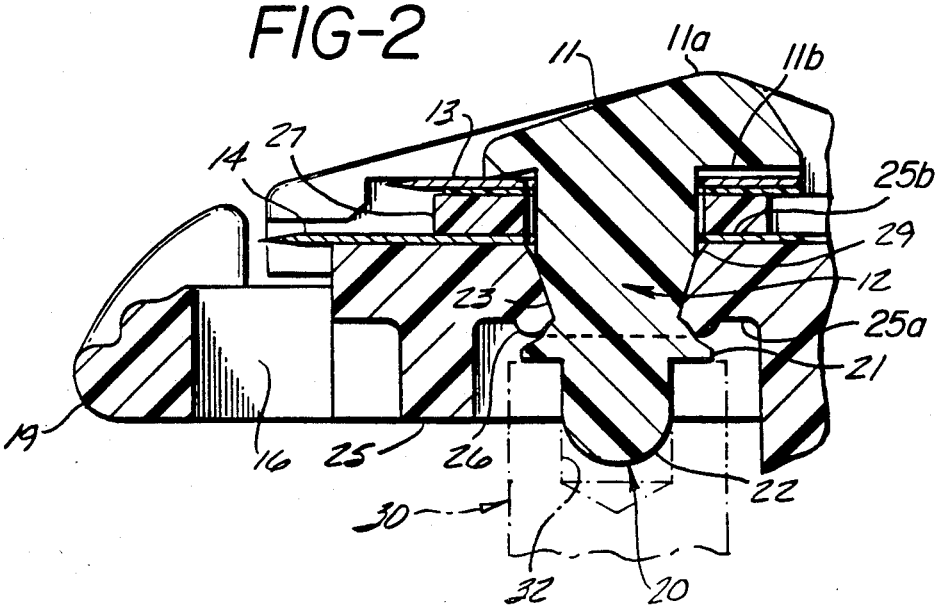
FIG. 2 is a view partially in cross section taken along lines 2—2 of FIG. 1.

The head of the pins 12 shown in phantom lines in FIG. 1 depends downward through the mating orifices in cap blade 13, spacer 27, seat blade 14 and seat 25. Skirt 21 extends radially circumferentially above the pin shaft 20 of pin 12 and is spaced from the spheroidal bottom or distal end 22 of the pin shaft 20. As can be seen in FIG. 2, the area adjacent the holes is deflected downward by the insertion of a stake of slightly greater diameter than the diameter of the aperture 29 in blade seat 25. While the downward deflection of portion 23 is much more likely to occur when the seat is chamfered, if the thickness of the seat is generally reduced, it can occur without chamfering.

Figure 3:
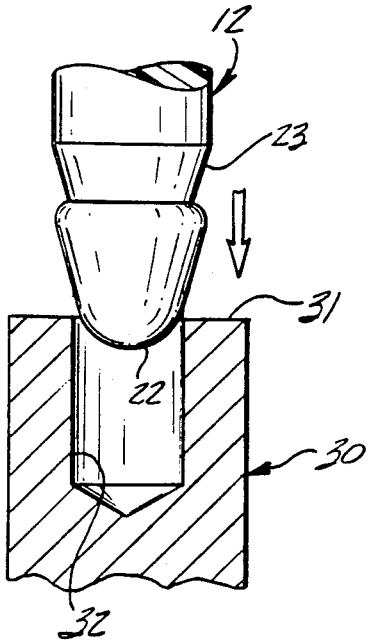
FIGS. 3 and 4 are representational views of the forming steps used for the stake skirt of this invention.
Figure 4:
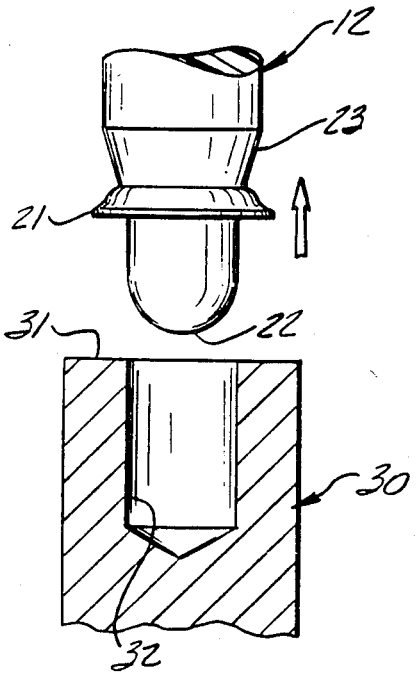

Turning now to FIGS. 3 and 4, FIG. 3 shows a pin such as that used in the pop bead configuration having a necked in portion 23 and a bulbous bottom portion 22 being directed toward fixture 30 having shoulders 31 and deforming, skirt-forming slot 32. As the pin shaft 20 is driven downward through the seat it initially engages fixture 30 and forces the bulbous portion 22 in contact with the edge of shoulders 31. The downward directing force pushes the portion 22 of the pin which is wider than slot 32 upward and outward to form skirt 21. After the skirt is formed, fixture 30 is lowered from the area directly beneath the bottom portion of seat 25 leaving the pin 12 with skirt 21 positioned above the bottom 22 of the pin and, in the case, where the pin having a necked in portion is utilized, the skirt portions are formed directly below the necked in portion.

While the skirt forming method described above can be practiced on pins having substantially uniform diameter along their length it is preferred to utilize a pin similar to that used in the pop bead configuration because less stress is placed on the pin along its length. The shear forces exerted on the pop bead type of pin exists primarily on the sides of the pin and therefore distribute forces essentially uniformly i.e., staking process is confined to a portion of the pins total cross sectional area thereby reducing the staking forces.

It is also necessary to use chamfered areas around the orifices of the seat because, according to this invention, the downwardly deflected surfaces 23 help maintain the locking configuration. While it is possible to generally bend the areas in the seat near the hole, by providing specific areas of reduced thickness and, concomitantly, decrease resistance to downward forces exerted by pushing the stake through the orifice, a more consistent locking system is formed.

Other variations on this invention will readily suggest themselves to those skilled in the art.

I claim:

1. A razor head comprising:

a seat having an inner surface and an outer surface;

a cap positioned in spaced relation from said seat, said cap having an inner surface and an outer surface;

at least one blade sandwiched between said inner surface of said seat and said inner surface of said cap, each said blade having a plurality of first apertures extending therethrough;

one of said seat and cap having a plurality of second apertures extending therethrough and in alignment with said first apertures of each said blade;

the other of said seat and cap having a plurality of pins extending therefrom through said first apertures of each said blade and through said second apertures, each said pin having a proximal end at which said pin is secured to said other of said seat and cap and a distal, free end;

at least some of said pins having a skirt formed thereabout at a position spaced from each said distal end so as to define a shaft portion between said skirt and said distal end, said skirt and said shaft portion each having a radial dimension and the radial dimension of said shaft portion being less than the radial dimension of said skirt, and said skirt being formed to extend toward the outer surface of said one of said seat and cap so as to secure together said seat, said cap and said at least one blade.

2. A razor head according to claim 1; wherein said razor head has a transverse center, there are four of said pins, and two of said pins are disposed symmetrically on each side of said center of said razor head.

3. A razor head according to claim 2; wherein there are two outermost ones of said pins, and said two outermost pins have said skirts formed thereabout.

4. A razor head according to claim 1; wherein all of said pins have said skirts formed thereabout.

5. A razor head according to claim 1; wherein each of said pins extends from the inner surface of said cap, and said second apertures are formed in said seat.

6. A razor head according to claim 1; wherein at least some of said pins each have a necked-in portion between said proximal end and said skirt thereof, and at least some of said second apertures have a chamfered area which receives said necked-in portion of said pins.

* * * * *